United States Patent [19]

King

[11] Patent Number: 4,911,332

[45] Date of Patent: Mar. 27, 1990

[54] CREAM AND SUGAR DISPENSER

[76] Inventor: Alan M. King, 465 Cote St., Antoine Road, Westmount, Quebec, Canada, H3Y 2K1

[21] Appl. No.: 266,652

[22] Filed: Nov. 3, 1988

[51] Int. Cl.[4] ..... B67D 5/52

[52] U.S. Cl. ..... 222/142; 222/144.5; 222/233; 222/271

[58] Field of Search ..... 222/412, 144.5, 145, 222/142, 138, 135, 129.1, 129.4, 252, 404, 271, 410, 413, 233, 506, 505, 476, 482, 556

[56] References Cited

U.S. PATENT DOCUMENTS

| | | | |
|---|---|---|---|
| 359,347 | 3/1887 | Cox | 222/142 |
| 2,901,148 | 8/1959 | Cunningham et al. | 222/556 |
| 3,377,964 | 4/1968 | Bell et al. | 222/135 |
| 4,066,186 | 1/1978 | Agey | 222/144.5 |
| 4,157,150 | 6/1979 | Hetrick | 222/413 |
| 4,508,243 | 4/1985 | Deutsch et al. | 222/142 |
| 4,802,609 | 2/1989 | Morse et al. | 222/233 |

*Primary Examiner*—Kevin P. Shaver
*Assistant Examiner*—Kenneth Noland

[57] ABSTRACT

A sugar and cream dispenser for an automatic coffee machine which prevents coffee or sugar from being dispensed into cups where the customer does not desire cream or sugar. The cream and sugar chutes are provided with moveable doors which are closed except when cream or sugar is to be dispensed into a cup. When the customer selects cream or sugar such doors open so that the cream or sugar can be dispensed into the coffee cup and at other times such doors are closed. The doors also prevent moisture and steam from passing up into the cream and sugar chutes so as to cause clogging of the machine. The machine also provides an easily removeable chute structure which can be quickly cleaned and replaced on the machine.

1 Claim, 2 Drawing Sheets

CREAM AND SUGAR DISPENSER

BACKGROUND OF THE INVENTION

1. Field of the Invention

This invention relates in general to automatic coffee vending machines and, in particular to novel cream and sugar dispensing chutes.

2. Description of the Prior Art

Automatic coffee dispensing machines are known in which a customer inserts coins and then presses a button to dispense coffee into a cup. Such machines allow the selection of cream and sugar with coffee and tea as desired. However, there has always been a problem in prior art machines in that the cream or sugar tends to fall off of the face of the dispenser spout when a machine is jiggled or touched. As a result, some cream or sugar is frequently deposited in the mixing bowl before a vend and if the next customer wants his drink without cream or sugar he still receives the amount which had been deposited. Also, steam from the machine has entered the prior art chutes causing clogging or jamming. The cream is normally in powder form.

SUMMARY OF THE INVENTION

While the application of this invention is shown as being used for powdered cream and granulated sugar, it can also be effectively used for powdered instant coffee, powdered fruit drinks, etc. with equally beneficial results.

It is a feature of the present invention to provide novel cream and sugar dispensing chutes in which solenoid operated doors are mounted over the ends of the chutes which remain closed until a customer desires cream or sugar to be dispensed into his coffee or tea. Such positively closed doors also prevent steam from entering into the chutes which would cause clogging and jamming in the chutes.

Another object of the invention is to provide easily removal cream and sugar chutes which can be cleaned in a rapid manner and replaced on the machine.

The invention is also applicable to a single reservoir and a single dispensing chute.

Other objects, features and advantages of the invention will become apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
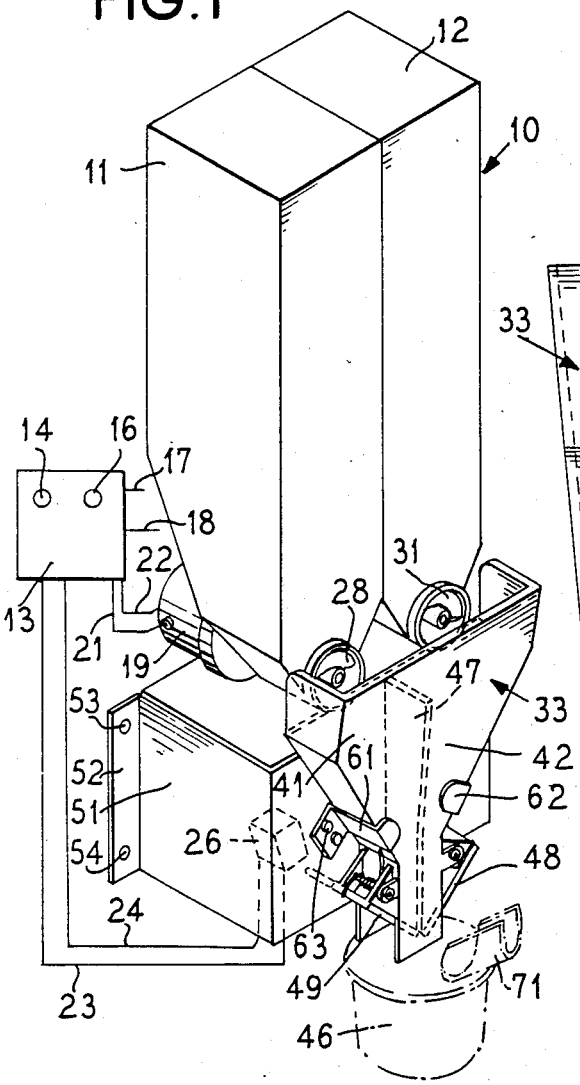
FIG. 1 is a perspective view of the cream and sugar chutes according to the invention.
Figure 2:
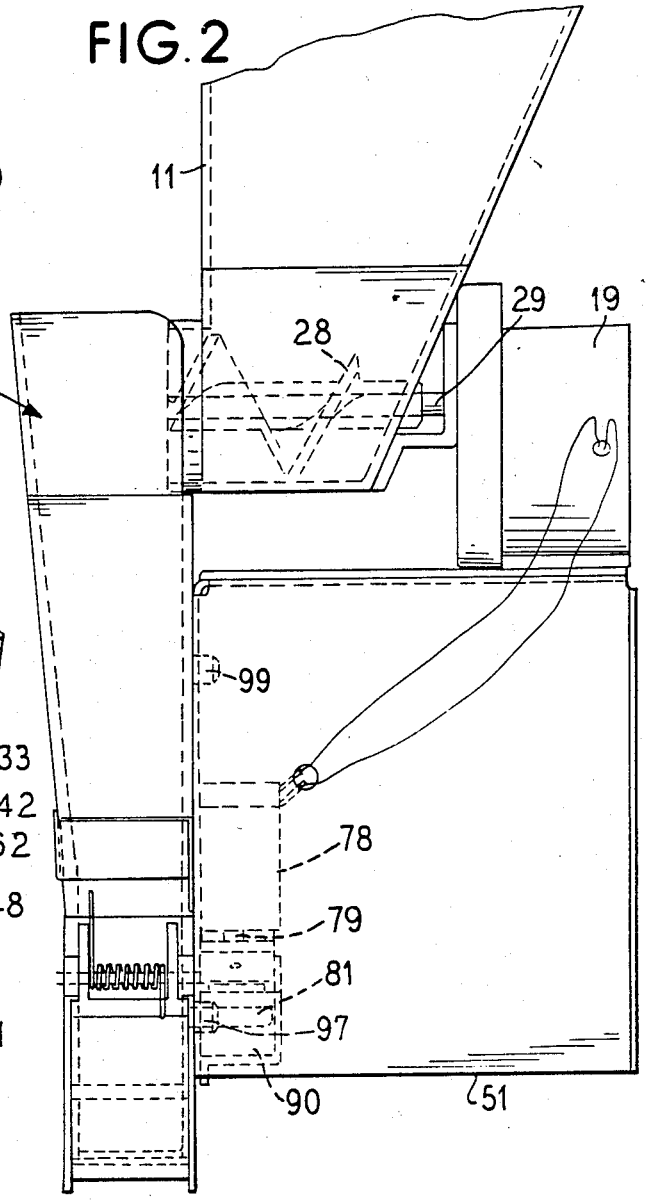
FIG. 2 is a sectional view through the machine.
Figure 3:
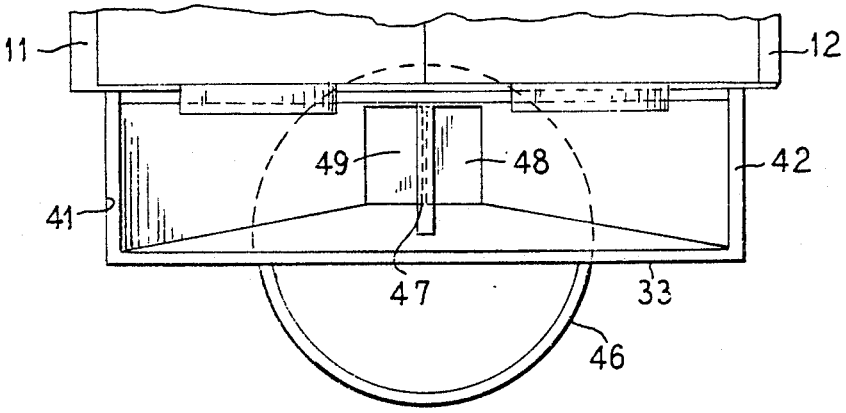
FIG. 3 is a top view illustrating the chute.

The FIGS. illustrate cream and sugar dispensers for a vending machine as, for example, a coffee or tea vending machine. FIG. 1 illustrates a cream reservoir 11 and a sugar reservoir 12 mounted side-by-side. The dispensing motor 19 is mounted to the bottom of the cream container 11 and drives an auger 28 which is connected to the drive shaft 29 of the motor 19. A second motor 20 is mounted on the lower portion of the sugar container 12 and drives an auger 31 connected to the output shaft 32 of the motor 20. A control box 13 has a cream demand button 14 and a sugar demand 16 as illustrated.

Figure 4:
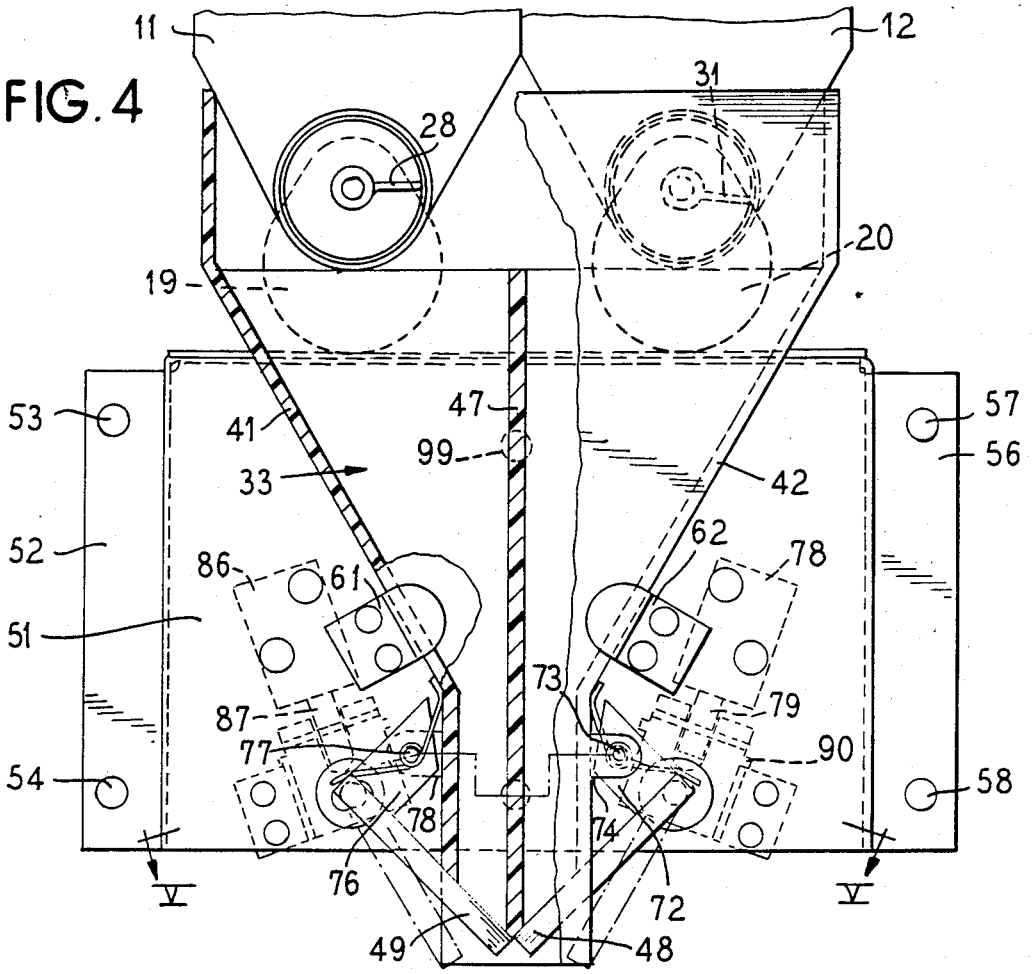
FIG. 4 is a sectional view illustrating the chutes.

A frame member 51 of generally rectangular shape is formed with flanges 52 and 56 on opposite sides through which openings 53, 55, 57 and 58 are formed as illustrated, for example, in FIGS. 1 and 4. The frame member 51 is mounted on the dispenser machine and the novel chute 33 of the invention is mounted to the frame member 51 by a pair of flexible holding brackets 61 and 62 which are attached to the frame member 51 by suitable rivets 63.

The chute 33 has a center divider 47 which separates the cream chute 41 from the sugar chute 42. A cup 46 is receivable at the smaller lower end of the chutes 41 and 42 as illustrated in FIG. 1 and the cream and sugar is selectively dispensed into the cup 46 as coffee is dispensed into the cup with a coffee chute 71.

Figure 5:
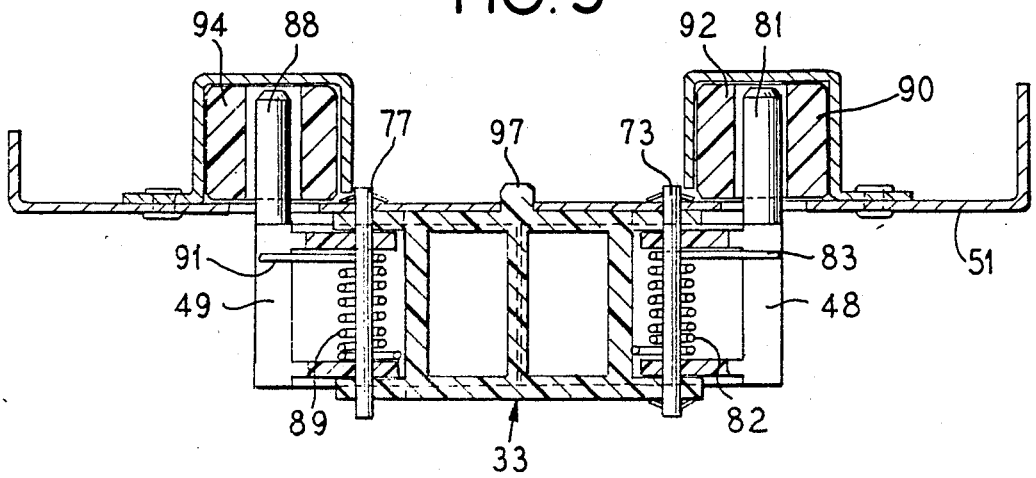
FIG. 5 is a sectional view illustrating the door structures.

Pivotally moveable doors 48 and 49 extend across the lower ends of the chutes 42 and 41 so as to prevent cream or sugar from falling into the cup 46. The door 48 has an arm 72 which is pivotally supported by shaft 73 on bracket 74 which is connected to the lower portion of the chute 42. The door 49 has an arm 76 which is pivotally supported by a shaft 77 from a bracket 78 that is connected to the lower portion of the chute 41 as shown in FIGS. 1 and 4, for example. A solenoid 78 has an armature 79 which is connected to a pin 81 which is connected to the door 48 as illustrated in FIG. 5. A spring 82 is supported on the shaft 73 and has an end 83 which engages the door 48 to bias it to the closed position. The pin 81 is connected to the door 48 and is connected to the armature 79 such that when the solenoid 78 is engaged, the armature 79 is moved upwardly relative to FIG. 4 and the armature 79 is pivotally connected to the pin 81 by a guide member 92 so as to open the door 48 to move it to the dash-dot position shown in FIG. 4.

A solenoid 86 is mounted to the frame member 51 and has an armature 87 which is connected to a pin 88 which is connected to the door 49 by a member 94. A spring 89 has an end 91 which normally biases the door 49 to the closed position except when the solenoid 86 is energized. When the solenoid 86 is energized, it opens the door 49 and moves it to the dash-dot position illustrated in FIG. 4.

The center portion of the chute 33 has extending pins 97 and 99 which are receivable in openings in the frame member 51.

In operation, the customer places a coin into the vending machine and then depresses one or both of the selector buttons 14 and 16 if cream or sugar is desired. As coffee is dispensed by the spout 71 into the cup 46 if the cream button 14 has been depressed, the motor 19 will be energized to drive the auger 28 thus supplying cream from the container 11 into the chute 41. Simultaneously, the solenoid 26 will be energized with the motor 19 and it will open the door 49 so that the cream in the chute 41 will pass into the cup 46. In a similar manner, if the sugar selector button 16 has been depressed, the motor 20 will be energized and the solenoid 78 will also be simultaneously energized to open the door 48 to allow the sugar to pass from the container 12 into the chute 42 and into the cup 46. It is to be noted in FIG. 1 that the control 13 has electrical leads 21 and 22 which are connected to the motor 19 and leads 23 and 24 which are connected to the solenoid 26. The motor 20 and solenoid 78 are also provided with energizing power from leads 17 and 18 shown in FIG. 1. If sugar or cream are not desired the doors 48 and 49 remain closed and sugar and cream cannot fall from the chutes into the cup 46.

When the chute 33 is to be cleaned, the flexible clamps 61 and 62 may be spread apart thus allowing the chute to be removed from the machine where it can be quickly cleaned and then replaced onto the machine by inserting the pins 99 and 97 into the frame member 51. The door actuating pins 81 and 88 also are reinserted into the members 92 and 94 which are actuated by the solenoids 86 and 78 so as to open the doors 49 and 48, respectively.

Although the invention has been described with respect to certain preferred embodiments, it is not to be so limited as changes and modifications can be made therein which are within the full intended scope as defined by the appended claims.

I claim as my invention:

1. A beverage dispensing machine for selectively dispensing substances such as powdered cream and sugar, instant coffee, powdered fruit drinks, powdered chocolate and instant tea into a cup and which prevents dispensing when such substances are not desired comprising, first and second reservoirs connected to said dispensing machine, side by side mounted first and second chutes respectively mounted to said dispensing machine below said first and second reservoirs so as to receive two substances therefrom and deliver such substances to said cup, a first door mounted relative to said first chute so that when it is closed one substance cannot be dispensed from said first chute, a second door mounted relative to said second chute so that when it is closed a second substance cannot be dispensed from said second chute, first means for supplying one substance from said first reservoir to said first chute, second means for supplying a second substance from said second reservoir to said second chute, third means for opening said first door, and fourth means for opening said second door, wherein said first means includes a first motor and a first auger mounted in said first reservoir, wherein said second means includes a second motor and a second auger mounted in said second reservoir, wherein said third means comprises a first solenoid connected to said control and to said first door to open it, wherein said fourth means comprises a second solenoid connected to said control and to said second door to open it, and wherein said first and second doors are pivotally connected to said first and second chutes and a first spring biasing said first door to the closed position and a second spring biasing said second door to the closed position, said chutes extend upward to house discharge outlets of said first and second augers and said chutes carry said first and second doors and said chutes are detachably mounted to the frame by mounting pins coupled to said first and second doors, a partition forming a common wall of said first and second chutes and said first and second chutes held in place by flexible holding brackets.

* * * * *